United States Patent [19]

Llames

[11] Patent Number: 5,075,996

[45] Date of Patent: Dec. 31, 1991

[54] SWIVEL ASSEMBLY FOR FIREARM

[76] Inventor: Emil C. Llames, 14 San Gregorio, Capitol-8, Pasig, Metro Manila, Philippines

[21] Appl. No.: 563,483

[22] Filed: Aug. 7, 1990

[30] Foreign Application Priority Data

Aug. 8, 1989 [PH] Philippines ..... 39113

[51] Int. Cl.[5] ..... F41C 23/02

[52] U.S. Cl. ..... 42/85

[58] Field of Search ..... 42/85

[56] References Cited

U.S. PATENT DOCUMENTS

| | | | |
|---|---|---|---|
| 2,078,591 | 4/1937 | Sprague | 42/85 |
| 4,571,872 | 2/1986 | Johnson | 42/85 |
| 4,665,641 | 5/1987 | Llames | 42/85 |
| 4,713,905 | 12/1987 | Dupuy | 42/85 |
| 4,823,491 | 4/1989 | Llames | 42/85 |

FOREIGN PATENT DOCUMENTS

| | | | |
|---|---|---|---|
| 8500423 | 1/1985 | PCT Int'l Appl. | 42/85 |
| 2165929 | 4/1986 | United Kingdom | 42/85 |

*Primary Examiner*—Charles T. Jordan

*Attorney, Agent, or Firm*—Eugene E. Renz, Jr.

[57] ABSTRACT

A sling swivel assembly for a firearm comprising a first U-shaped swivel secured to the lower face of the rifle butt and designed to pivot about the butt of the rifle and assembled in a manner to allow the sling to be placed above, at the end or at the bottom of the butt allowing for effective firing of the rifle while still slung on the shoulder. An inverted U-shaped flexible connecting member secured at the free terminal ends of the first swivel member supports the sling at one end. The sling swivel assembly further includes a triangular front swivel of a predetermined configuration so that it can be attached to the rifle by pulling apart overlapping components at one side of the triangle and inserting the fore end attachment of the rifle. The sling is then secured to the triangular front swivel such that the triangular front swivel cannot be detached from the rifle without first removing the sling.

3 Claims, 5 Drawing Sheets

SWIVEL ASSEMBLY FOR FIREARM

FIELD OF THE INVENTION

The present invention relates to swivel assemblies for firearms and more specifically to an ambidextrous "quick point" rifle and shotgun sling swivel assembly

BACKGROUND OF THE INVENTION

Swivel assemblies are located at the lower side of the rifle butt and the other end is connected along the bottom of the forearm support piece of the rifle. The strap and swivel assemblies are designed mainly to support the firearm, such as a rifle or shotgun, at the back of the shoulder during parades or on long hikes. However, in combat, or when using the firearm, the sling is superfluous and in some instances cumbersome since the firearm must be either unslung from the shoulder, or else the sling interferes with the firing of the firearm while slung on the shoulder.

Various attempts have been made in the prior art to improve the swivel and sling assembly which have only been moderately successful. For example, it has been know to place the swivel to one side of a firearm such as in a German submachine gun known as a Schmeisser MP-40. This design permitted the firing of a weapon from waist level if need be, with the sling attached at the shoulder. Firing a weapon from the hip or waist lowers the accuracy, and, in most instances, the ability to hit a target beyond ten meters from this position is a matter of guess work.

SUMMARY OF THE INVENTION

With the foregoing in mind, it is an object of the present invention to provide a sling swivel assembly which eliminates the disadvantages and limitations inherent in the prior art sling swivel assemblies, and which is characterized by novel features of construction and arrangement allowing the firearm to be carried or supported by the sling from the shoulder in various positions while still allowing for effective firing of the firearm from either at the hip, or at the shoulder while so carried or supported.

Still another object of the present invention is to provide a sling swivel assembly wherein the accuracy of fully automatic firing is vastly improved by reason of the fact that the position of the swivel and sling in relation to the firearm creates an opposing line of force against the recoil of the firearm.

Still another object of the present invention is to provide a sling swivel assembly permitting easy attachment of the triangular front swivel to the fore end attachment of the firearm, yet not allowing the triangular front swivel to be detached without first removing the attached sling.

Still another object of the present invention is to provide a sling swivel assembly wherein the end of the sling is enclosed by other portions of the sling which is threaded through the adjustment buckle whereby the loose end of the sling does not interfere with the use of the firearm.

Still another object of the present invention is to provide a sling swivel assembly wherein the adjustment buckle is such that the threaded sling does not slip after adjustment.

BRIEF DESCRIPTION OF THE DRAWINGS

These and other objects of the present invention and the various features and details of the operation and construction thereof are hereinafter more fully set forth with reference to the accompanying drawings, where.

DETAILED DESCRIPTION OF THE PREFERRED EMBODIMENT

Figure 1:
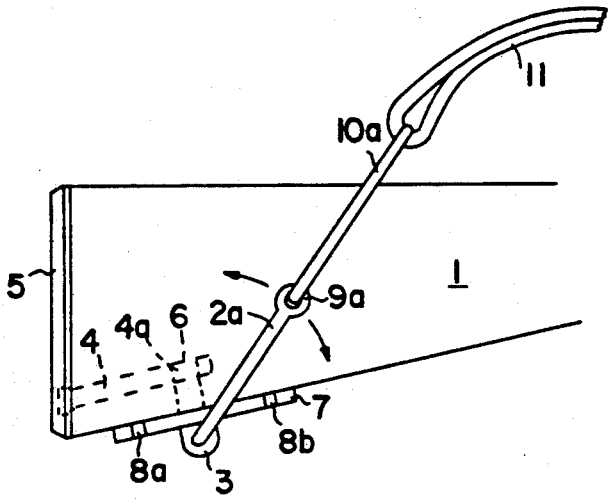
FIG. 1 is a side elevational view of a sling swivel assembly mounted on the lower side of the butt of a firearm such as a rifle and incorporating features of the present invention.
Figure 2:
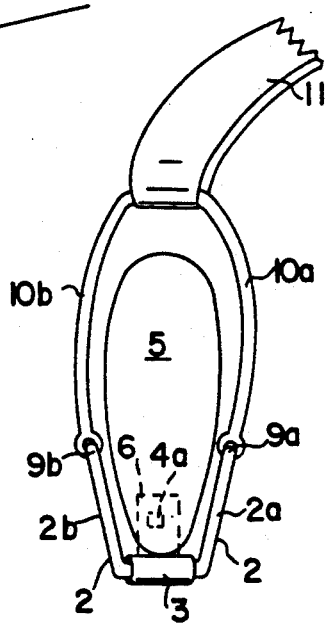
FIG. 2 is a rear view of the sling swivel assembly shown in FIG. 1.
Figure 3:
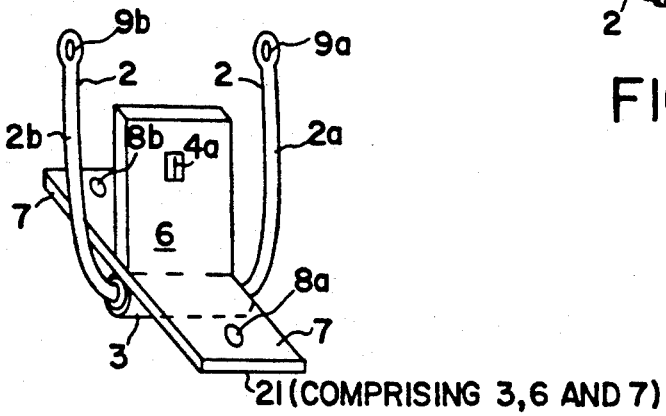
FIG. 3 is a perspective view of the assembly detached from the rifle butt.

Referring now to the drawings and particularly to FIGS. 1-3 thereof, there is shown a swivel assembly, consisting of a rear swivel assembly, a front swivel assembly and attached between them a sling with adjustment buckle for a firearm constructed in accordance with the present invention. The rear swivel assembly as shown is mounted to the lower side of the butt 1 of a rifle. In the preferred embodiment for an M-16 Assault Rifle, the rear swivel assembly includes a one piece plate assembly 21. Plate assembly 21 comprises main swivel anchor 6, auxiliary anchor plate 7 which straddles and is perpendicular to the main swivel anchor 6, and tubular receptacle 3 located exterior to, and at the midpoint of, the auxiliary anchor plate 7 where the main swivel anchor 6 extends perpendicularly into the butt 1 of the rifle.

The main swivel anchor 6 is a generally rectangular plate which fits in a rectangular opening extending upwardly from, and perpendicular to, the lower side of the butt 1 of the rifle. Bolt 4, which already exists in an M-16 Assault Rifle, passes through butt plate 5 on the axial end of the butt 1 of the rifle and engages main swivel anchor 6 through the threaded anchor hole 4*a*. The plate assembly 21 may also include an auxiliary anchor plate 7 of a generally rectangular configuration which straddles the main swivel anchor 6 and is secured to the lower side of the butt 1 of the rifle by screw fasteners which engage through screw holes 8*a* and 8*b* into the lower side of the butt 1 of the firearm as shown.

In an alternate embodiment, if the firearm does not provide an opening in the butt of the rifle for the insertion of main swivel anchor 6, then main swivel anchor 6 must be cut-off or removed from the plate assembly 21. The rear swivel assembly is then mounted to the butt 1 of the rifle by the auxiliary anchor plate 7 secured to the lower side of the butt 1 of the rifle by screw fasteners which engage through screw holes 8*a* and 8*b*.

In the preferred embodiment, a generally U-shaped swivel 2, consisting of swivel legs 2*a* and 2*b*, is pivotally mounted through tubular receptacle 3 to plate assembly 21. The outer free terminal ends of swivel legs 2*a* and 2*b* terminate in attachment means, in the present instance, eyelet openings 9*a* and 9*b*, for a flexible sling 10 consisting of sides 10*a* and 10*b*. The flexible sling 10 is preferably made of a strong, flexible material such as nylon cord and, as illustrated, is pivotally mounted at its outer free ends in the eyelet openings 9*a* and 9*b* of the rigid, pivotally mounted swivel 2. The flexible sling 10 forms an inverted V-shape, embracing and passing through the sling 11 as best illustrated in FIGS. 1 and 2.

Figure 4:
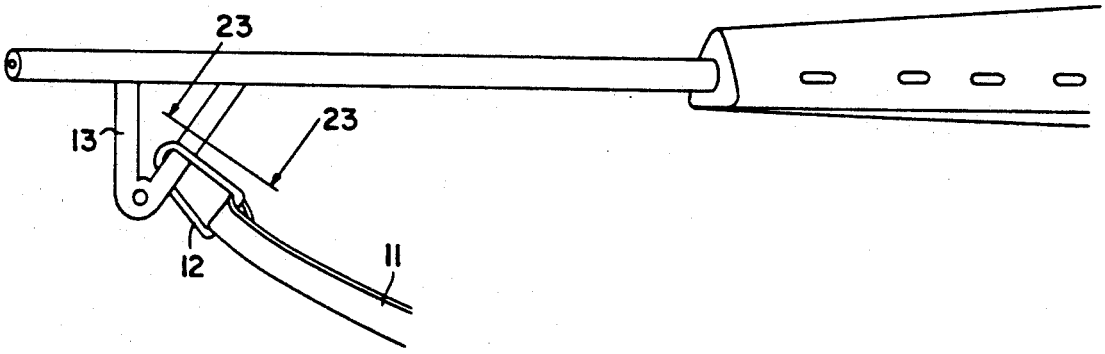
FIG. 4 is a side elevational view of the front sling swivel assembly of the preferred embodiment attached to the rifle fore end attachment of an inverted rifle.
Figure 5:
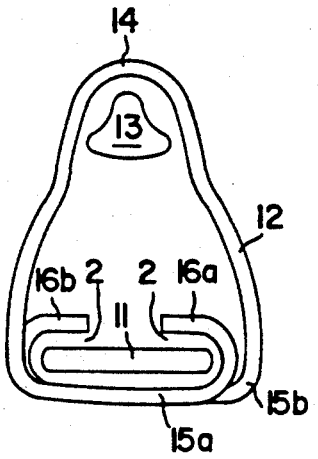
FIG. 5 is plan view of the front sling swivel assembly taken on lines 23—23 of FIG. 4.
Figure 7:
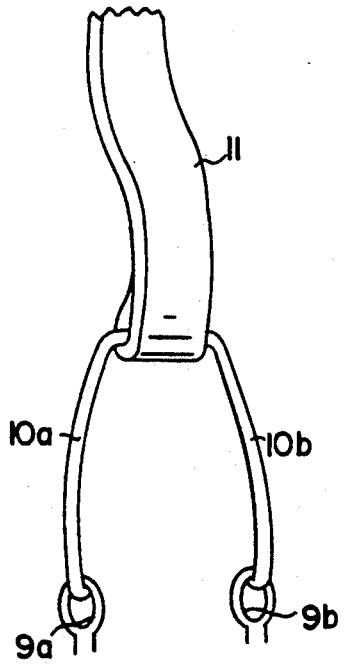
FIG. 7 is a perspective view of one end of the sling for attachment to the rear sling swivel assembly.
Figure 6:
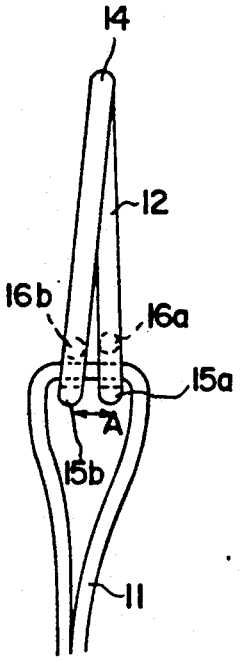
FIG. 6 is a side elevational view of the front sling swivel assembly.

The sling 11 is pivotally mounted at its opposite end by the front swivel assembly, by way of a triangularly shaped front swivel 12 which is linked to the rifle fore end attachment 13 as illustrated in FIG. 4. The front swivel 12 is attached to rifle fore end attachment 13 (the front sight of the rifle in the case of an M-16 Assault Rifle) by widening the gap "A" between ends 15*a* and 15*b* of front swivel 12 (see FIG. 6 for gap "A") and then inserting therein a portion of the rifle fore end attachment 13, so that front swivel 12 and rifle fore end attachment 13 are linked together. The sling 11 is then threaded through front swivel 12 thus preventing front swivel 12 from unlinking with rifle fore end attachment 13 as shown in FIGS. 4, 5 and 6. The front swivel 12 is preferably a bendable metal so that it can be made into a triangular shape with its ends 15*a* and 15*b* overlapping in side by side array as shown in FIG. 6, and being reversibly bent to form a retaining channel 22 almost completely encircling the sling 11 and permitting freedom of movement of the sling as shown in FIGS. 5 and 6.

Figure 8:
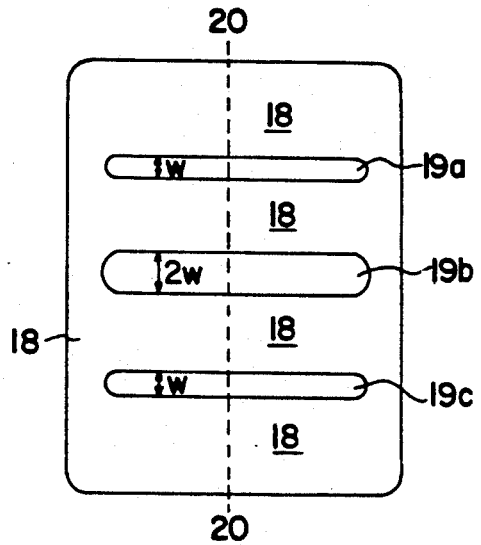
FIG. 8 is a top plan view of a three slot adjustment buckle for the strap.
Figure 9:
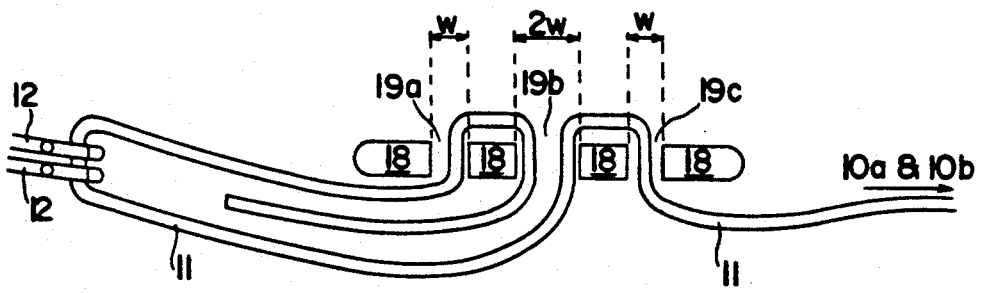
FIG. 9 is a fragmentary sectional view of the adjustment buckle taken on lines 20—20 of FIG. 7.

Shown in FIGS. 8 and 9 is adjustment buckle 18 for mounting the sling relative to the swivel assemblies in an endless loop and permitting adjustment. The adjustment buckle 18 as illustrated is a generally rectangular plate having three spaced elongated slotted openings 19*a*, 19*b*, and 19*c* wherein the outer slots, 19*a* and 19*c*, are of a narrower width than the middle slot 19*b*. The outer slots 19*a* and 19*c* are of a width, W, to accommodate the thickness of one sling whereas the center slot 19*b* is of a width, 2W, to accommodate the thickness of two slings t permit the threading of the sling through the adjustment buckle in the manner shown in FIG. 9. This threading arrangement and the buckle facilitate a non-slip attachment and yet one that can be adjusted quickly to shorten or lengthen the sling 11.

Figure 10:
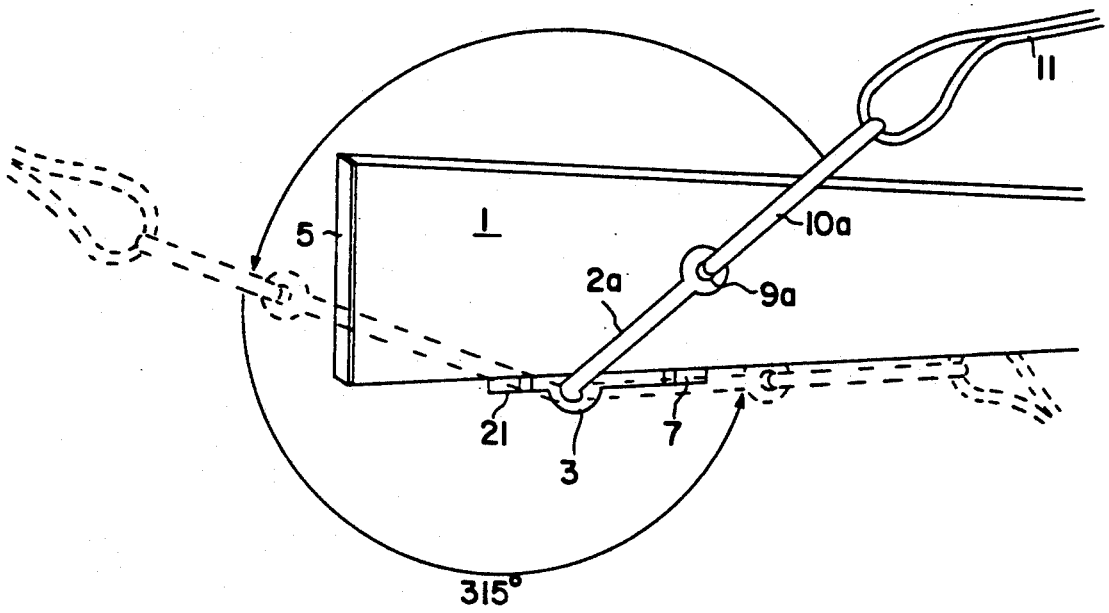
FIG. 10 is a side elevational view of a sling swivel assembly mounted on the lower side of the butt of a firearm showing the range of positions available for the rear swivel assembly about the butt of a firearm.

Shown in FIG. 10 is the range of positions available for the rear swivel assembly. The rear swivel assembly with sling 11 can be rotated approximately 315 degrees about tubular receptacle 3 allowing the rear swivel assembly with sling 11 to be positioned above, at the end or at the bottom of the butt 1 of the rifle. The length of flexible sling 10 is such that, combined with the length of swivel legs 2*a* or 2*b* of swivel 2, the rear swivel assembly can be rotated about tubular receptacle 3 as shown in FIG. 10.

While particular embodiments of the present invention have been illustrated and described herein, it is not intended to limit the invention and changes and modifications may be made therein within the scope of the following claims.

What is claimed is:

1. A sling assembly for use with a firearm having a butt portion and a fore-end attachment, comprising:

a strap having first and second ends;

a rear swivel assembly attached to the butt portion of the firearm including a rotatable U-shaped member and a flexible rope attached at each end to one end of the U-shaped member, the first end of the strap being attached to the rear swivel assembly via the flexible rope and rotatable relative to the butt portion about an arc in a passing through the top, the end and the bottom of the butt portion; a front swivel attached to the fore-end attachment, including a rotatable, flexible, triangular shaped swivel with reversibly bent, side by side, overlapping ends which form a retaining channel, the second end of the strap being attached to the front swivel assembly and positioned within the retaining channel such that the strap must be detached from the front swivel assembly before the front swivel assembly can be detachable from the fore-end attachment.

2. A sling assembly according to claim 1 wherein the arc is about 315°.

3. A sling assembly according to claim 1 wherein the rear swivel assembly further includes a T-shaped plate means for retrofit mounting on an M-16 Assault Rifle.

* * * * *